United States Patent [19]

Hays

[11] 4,193,651

[45] Mar. 18, 1980

[54] IGNITION WIRE IMPROVEMENTS

[76] Inventor: Bill J. Hays, 10582 Palladium Ave., Garden Grove, Calif. 92640

[21] Appl. No.: 952,851

[22] Filed: Oct. 19, 1978

[51] Int. Cl.[2] ..... H01T 13/04

[52] U.S. Cl. ..... 339/28; 174/86; 339/26; 339/245

[58] Field of Search ..... 339/10, 26, 27, 28, 339/29 R, 29 B, 143 S, 149 S, 213 S, 218 S, 223 S, 245; 174/77 S, 86; 123/148 A; 138/DIG. 8

[56] References Cited

U.S. PATENT DOCUMENTS

| | | | |
|---|---|---|---|
| 2,165,323 | 7/1939 | White | 339/223 S |
| 3,024,438 | 3/1962 | Trush | 339/28 |
| 3,867,001 | 2/1975 | Hedman | 339/26 |
| 3,918,789 | 11/1975 | Davis | 339/245 |

*Primary Examiner*—Neil Abrams

*Attorney, Agent, or Firm*—Fulwider, Patton, Rieber, Lee & Utecht

[57] ABSTRACT

There is disclosed an improvement in ignition wire for internal combustion engines, particularly automotive engines, which comprises a short length of malleable, insulated metal conductor bearing a spark plug terminal connector at one end and, at the opposite end, a connector for attachment to a major length of the conventional, flexible, non-self-supporting ignition wire. The short length is of a self-supporting construction, typically of a solid core, heavy gauge metal wire that will retain a shape imparted to the conductor whereby the conductor can be bent into a form which spaces the conductor a safe distance from hot surfaces such as the exhaust manifold and from the other ignition wires.

6 Claims, 4 Drawing Figures

FIGURE 1
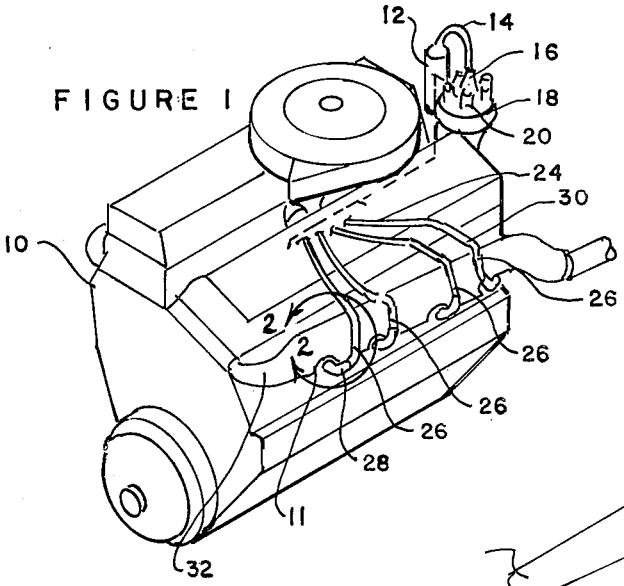
FIGURE 2
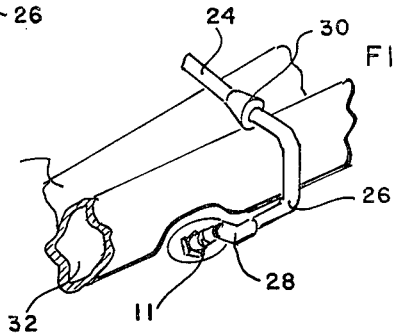
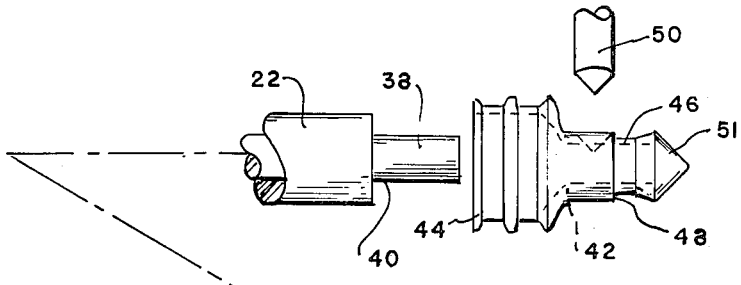
FIGURE 3
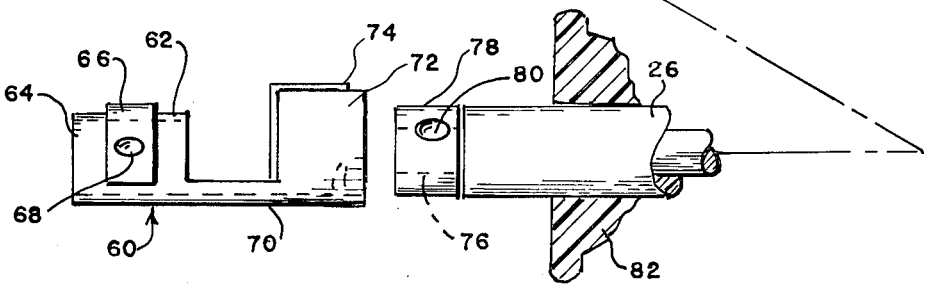
FIGURE 4

IGNITION WIRE IMPROVEMENTS

BACKGROUND OF THE INVENTION

Ignition wires commonly used on automotive engines are entirely flexible and non-self-supporting. Customarily, these wires are draped over the engine components and are often secured at spaced locations by spacers or retainers which are brackets that are secured to the engine components. Typically, the ignition wire is a cable of multiple strands of metal wire such as copper and aluminum wire or is a cotton or plastic fiber that is impregnated with carbon for the necessary conductivity. The carbon impregnated conductors are frequently used since these conductors reduce the amount of radio interference otherwise caused by the automotive ignition system. These conductors commonly bear a distributor terminal connector and, at the opposite end, a spark plug connector and these connectors are commonly surrounded by insulator sleeves or "boots".

A frequent problem in source of ignition failures comprises burnt or destroyed insulation which results from direct exposure of the ignition wires to hot engine surfaces, such as exhaust manifolds. Typically, the exhaust manifolds are located in close proximity to the spark plugs and this location requires that the ignition wires pass in near direct contact with the hot exhaust manifold.

BRIEF DESCRIPTION OF THE INVENTION

This invention comprises an improvement for automotive ignition conductors in the form of a short length of malleable, self-supporting, insulated metal conductor distally bearing, at one end, a spark plug terminal connector and, at the opposite end, a connector for attachment to the conventional, flexible ignition conductor for the engine. The invention also comprises the assembly of this short length of self-supporting, malleable, insulated conductor with a major length of a flexible, non-self-supporting ignition conductor, and finally, to the combination of an automotive engine having spark plugs interconnected to a distributor with the aforementioned assembly of short and major lengths of ignition conductors.

BRIEF DESCRIPTION OF THE DRAWINGS

The invention will be described with reference to the FIGURES of which:

FIG. 1 is a side view of a typical automotive engine having ignition conductors employing the invention;

FIG. 2 is an enlarged view of portion 2—2 of FIG. 1;

FIG. 3 is an exploded view of the preferred connector terminal and cable used for interconnection to the flexible, non-self-supporting ignition conductor; and FIG. 4 is an exploded view of the assembly of self-supporting conductor and spark plug terminal connector of the invention.

DESCRIPTION OF PREFERRED EMBODIMENT

Referring now to FIGS. 1 and 2, the invention is shown in application to an otherwise conventional automotive engine 10. This engine has a plurality of spark plugs 11 which typically are in a line array longitudinally disposed along the engine at one or both sides, depending upon the number and configuration of the engine cylinders. The engine also includes a distributor 18 and coil 12 which are used in the conventional Kettering ignition that utilizes the collapse of a magnetic field in the primary windings of coil 12 to generate a high voltage current that is applied through insulated conductor 14 to a central terminal 16 of distributor 18. The distributor has an internal rotor (not shown) that directs the high voltage discharge from the coil 14 to one of a plurality of circumferentially positioned terminals 20. Each of the terminals 20 receives a distributor terminal connector distally carried by a flexible, non-self-supporting, length of ignition wire 24. The ignition wire 24 extends to one of the plurality of spark plugs 11.

The invention is incorporated in the aforedescribed engine by the inclusion, with each length of spark plug wire 24, a shorter length of malleable, self-supporting, insulated conductor 26. The latter has a spark plug terminal connector and insulator boot, generally indicated at 28, for connection to its respective spark plug and, at its opposite end, a connector terminal and insulator sleeve, generally designated at 30 for connection to the end of the flexible, non-self-supporting ignition wire 24.

The malleable load supporting length 26 of the ignition conductor is formed into a shape which permits it to be looped about the hot surfaces of the engine such as the exhaust manifold 32 and the self-supporting characteristic of this conductor insures that the conductor remains out of contact with and in the desired spaced-apart relationship to the exhaust manifold.

Referring now to FIG. 3, the terminal connector employed with the load supporting ignition wire of the invention will be described in greater detail. As shown in FIG. 3, the ignition wire comprises a single, solid core wire 38 of a gauge from 6 to about 14 gauge thickness, preferably about 10 gauge thickness. The wire is jacketed by an insulating coating 22 which, preferably, is an extruded plastic coating such as silicone rubber and the like. The end 40 of the load supporting ignition wire is bared of insulation and is inserted into a receiving bore 42 of a male connector terminal 44. Preferably, the connector terminal 44 simulates the shape of a typical spark plug terminal, having a peripheral groove 46 intermediate the length of its terminal shank 48. The preferred form of the terminal has a bulbous end 51 and is formed of metal tubing by stamping or spinning manufacturing methods. The bared end 40 of the ignition wire is received within bore 42 and is retained therein by upsetting the surrounding shank 48 of the terminal connector. This is accomplished by punching the connector with a punch 60.

Referring now to FIG. 4, the spark plug terminal connector and its attachment to the load supporting ignition wire of the invention will be described. The spark plug terminal connector 60 has a conventional spark plug terminal connector portion 62 which is defined by a circular sleeve 64 with an overlying band 66 about a portion of its periphery. The band 66 is located intermediate the length of sleeve 62 and has one or more indentations 68 that are formed therein and that project into the interior wall of the sleeve portion 62, whereby the inward indentation of this wall serves as detenting protrusions that are captured within the peripheral groove of the spark plug, for example, see peripheral groove 46 of FIG. 3. The sleeve portion 62 of the spark plug terminal connector is carried on the longitudinal wall 70 which distally bears radial tabs 72 and 74. The end of the load supporting conductor 26 is bared and the bare end of the solid core metal conductor 38 is received in the central aperture 76 of collar 78. The collar is secured to the conductor 38 by an upset portion 80 effected by punching the collar with punch 58.

The resultant collar and conductor assembly is then inserted into the open portion of the sleeve 60 and the tabs 74 and 72 are bent about the insulated coating 22 of the conductor. Thereafter, the conventional spark plug insulated sleeve or boot 82 can be advanced over the connector terminal.

The malleable, load supporting ignition conductors of the invention can be provided in a plurality of varied lengths, typically, from 4 to about 16 inches, preferably, from 6 to about 12 inches, and these lengths will be sufficient to form the conductors about substantially all the hot surfaces such as exhaust manifolds found on most automotive engines. The self-supporting ignition wires of the invention can be coupled to the conventional ignition wires which can be the insulated cables of flexible wires such as copper and aluminum wires or the carbon-impregnated cotton and plastic woven strands of fibers. The solid core conductor 38 employed in the self-supporting ignition conductor of the invention can be of any suitable electrically conducting metal, e.g., copper, low carbon or stainless steel, etc. It has been found in practice that low carbon or mild steel wire of the previously mentioned thickness which is insulated with a silicone rubber coating of 0.16 thickness is ideally suited for use in the invention.

The invention has been described with reference to the illustrated and presently preferred embodiment. It is not intended that the invention be unduly limited by this description of a preferred embodiment. Instead, it is intended that the invention be defined by the means, and their obvious equivalents, set forth in the following claims.

What is claimed is:

1. An ignition conductor for an internal combustion engine having hot surface protrudances adjacent to spark plugs which comprises an assembly of a spark plug terminal connector interconnected to a major length of a flexible, insulated, non-self-supporting conductor distally bearing a distributor terminal by a shorter length from 4 to about 16 inches of a malleable, self-supporting, solid core, insulated conductor formed into a self-supporting shape to pass about, in spaced-apart relationship, said hot surfaces.

2. The conductor of claim 1 wherein said shorter length of conductor is a solid-core low carbon steel metal wire from 8 to 14 guage in thickness covered with an insulating coating.

3. The conductor of claim 2 wherein said major and shorter lengths of conductors are interconnected by a detachable connector assembly.

4. The conductor of claim 3 wherein said connector assembly comprises a male terminal connector of the shape and size of a conventional spark plug terminal distally carried by said shorter length conductor and a spark plug terminal connector distally carried by said major length conductor.

5. The conductor of claim 4 wherein said male terminal connector is a sleeve having a large diameter end to receive said conductor and insulator coating and a terminal shank of lesser diameter to receive said conductor.

6. The conductor of claim 5 wherein said male terminal connector is secured to said shorter length of conductor by an upset indentation.

* * * * *